US005425674A

United States Patent [19]

Stach

[11] Patent Number: 5,425,674

[45] Date of Patent: Jun. 20, 1995

[54] COVER FOR SWAMP COOLER AND METHODS

[76] Inventor: William R. Stach, 1027 N. Kimberly Dr., Layton, Utah 84041

[21] Appl. No.: 143,265

[22] Filed: Oct. 26, 1993

[51] Int. Cl.[6] ..... F24F 13/20

[52] U.S. Cl. ..... 454/370; 454/299

[58] Field of Search ..... 454/201, 259, 270, 293, 454/299, 370

[56] References Cited

U.S. PATENT DOCUMENTS 4,231,288 11/1980 Finley ..... 454/370 X
4,287,815 9/1981 Henderson ..... 454/370 X
4,322,114 6/1982 Goeber et al. ..... 454/201
4,732,012 3/1988 Thorpe ..... 454/259

*Primary Examiner*—Harold Joyce
*Attorney, Agent, or Firm*—Lynn G. Foster

[57] ABSTRACT

An impervious contour closure for preventing air flow through a swamp cooler and related methods, which can be easily and quickly utilized by a lay person having little or no technical training. Installation of the novel closure requires no alteration to the cooler itself, effectively seals against an interior and exterior building wall around the cooler against air flow through the cooler, and provides an attractive appearance. In the spring, the steps of installation can be facilely reversed to implement the cooler for use during warm and hot weather.

9 Claims, 1 Drawing Sheet

COVER FOR SWAMP COOLER AND METHODS

FIELD OF INVENTION

The present invention relates generally to the field of swamp coolers and, more particularly, to a cover, canopy or closure for swamp coolers and to related methods.

BACKGROUND

Swamp coolers are used, particularly in low humidity environments, to lower the temperature within a house or other building during the summer months. Typically, in a swamp cooler, water in a reservoir is pumped to an elevated location and caused to flow downwardly under force of gravity through porous pads. The pads are located at exterior air vents through which air is caused to flow by operation of a squirrel-cage blower. Thus, moisture-laden cool air is delivered through interior air vents to the interior of the house or other building.

Swamp coolers are commonly mounted on a roof, in a wall and/or in a window area of the house or other building.

During the late fall, winter, and early spring, it is important to prevent undesired flow of cool and cold air from the atmosphere through the swamp cooler into the house or other building. Various ways have been proposed for solving the above-mentioned undesired flow of cool and cold air into the house or other building. Hoods of canvas or other flexible sheet material have been placed over the exterior of such swamp coolers. Plugs of non-porous insulating material have been placed within such swamp coolers. Impervious sheet material has been placed over the interior air discharge vent. Sometimes the swamp cooler has been removed and the resulting hole temporarily filled or plugged.

None of the proposals mentioned immediately above have proven to be efficacious and otherwise satisfactory to the consumer. Hoods of flexible sheet material, over time, tend to become pervious and they lack eye appeal. Sheet material over the interior discharge site likewise materially detracts from the aesthetic appearance within the home or other building. Interior plugs do not always seal the swamp cooler against air flow and persons having some technical competence are required for placement of the interior plugs. Many untrained homeowners cannot use either the interior plug or the total removal approach themselves because of a lack of technical competence and some of these people lack funds with which to hire others having technical competence to provide the needed service.

BRIEF SUMMARY AND OBJECTS OF THE PRESENT INVENTION

In brief summary, the present invention overcomes or substantially alleviates the aforesaid problems of the prior art. A novel cover, canopy or closure for a swamp cooler and related methods are provided, which can be easily and quickly utilized by a lay person having little or no technical training. Installation of the novel cover requires no alteration to the cooler itself, effectively seals against air flow through the cooler, and provides an attractive appearance. In the spring, the steps of installation can be facilely reversed to implement the cooler for use during warm and hot weather. In its preferred form, the present invention comprises a rigid, impervious canopy which encases an otherwise exposed portion of the swamp cooler and is biased into a sealed, encasing relationship against a ceiling or wall surface of a house or other building. While it is preferred that the canopy be placed inside the house or other building, the principles of the present invention apply to exterior placement or both.

With the foregoing in mind, it is a primary object of the present invention to overcome or substantially alleviate the problems of the prior art.

Another object of significance is the provision of a novel cover, canopy or closure for a swamp cooler and related methods.

A further important object is the provision of a novel swamp cooler cover, canopy or closure and related methods which can be easily and quickly installed by lay persons having little or no technical training.

A dominant object is the provision of a novel cover, canopy or closure for a swamp cooler, installation of which requires no alteration to the cooler itself.

A further paramount object is the provision of a novel cover, canopy or closure for a swamp cooler and related methods which effectively seals against air flow through the cooler into a house or other building.

Another object of value is the provision of a novel cover, canopy or closure for a swamp cooler and related methods which is both efficacious and attractive in appearance.

Another basic object is the provision of a novel cover, canopy or closure for a swamp cooler which works well and can be easily and quickly installed and later removed by a person having little or no technical training.

A further object of the present invention is the provision of a rigid canopy or closure to encase one exposed side of a swamp cooler to prevent air flow therethrough.

Another important object is the provision of a novel rigid canopy or closure which both encases a swamp cooler and seals under force of a bias against a building surface to prevent air flow through the cooler during times of cool and cold weather.

A further object is the provision of a novel cover, canopy or closure for a swamp cooler and related methods, which can be used interiorly and/or exteriorly.

These and other objects and features of the present invention will be apparent from the detailed description taken with reference to the accompanying drawings.

DETAILED DESCRIPTION OF THE ILLUSTRATED EMBODIMENTS

Figure 1:
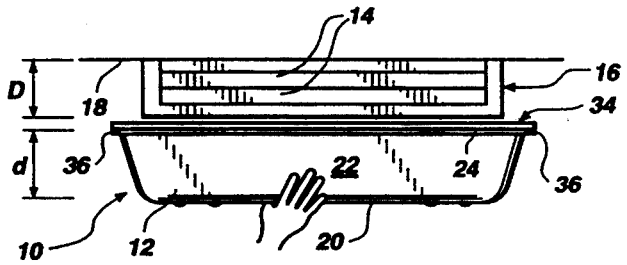
FIG. 1 is a side elevation of a cover or canopy in accordance with the principles of the present invention being installed over the interior portion of louvered discharge vents of a swamp cooler.
Figure 2:
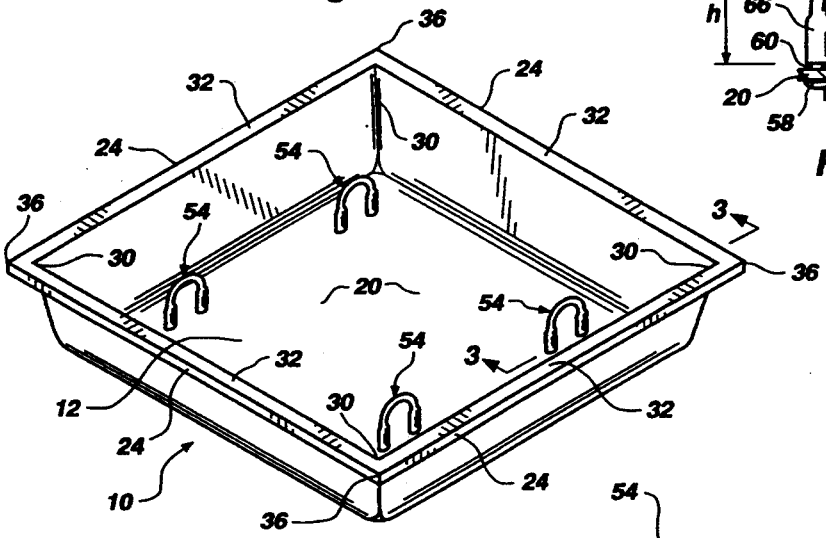
FIG. 2 is a perspective representation of the cover or canopy of FIG. 1, looking downwardly into the interior thereof.

Specific reference is now made to the drawings wherein like numerals are used to designate like parts throughout. One hood, canopy, cover, or closure embodiment, generally designated 10, is illustrated in FIGS. 1 and 2. Contoured, impervious hood 10 comprises an impervious, disk-shaped and otherwise contoured canopy 12 formed of a suitable synthetic resinous material, such as high impact polystyrene, so as to be generally interiorly concave and exteriorly convex as illustrated in FIGS. 1 and 2. The depth "d" of the contoured hood 12 (see FIG. 1) is greater than the exposed dimension "D" of the projecting air vent (louvered) structure 14 of the swamp cooler 16, if any projection there may be, so that a peripheral seal can be achieved as explained hereinafter in greater detail.

It is to be appreciated, in respect to FIG. 1, that the projecting portion of swamp cooler 16 is intended to be representative of roof-mounted swamp coolers, wall-inserted swamp coolers, and, in certain instances, window-mounted swamp coolers. As illustrated in FIG. 1, the swamp cooler 16 is illustrated as extending through a building wall and beyond a building surface 18, which can be a ceiling surface, a wall surface, or a window surface.

The impervious, rigid, contoured canopy or closure 12 is illustrated as being of essentially uniform thickness throughout and comprises, in one piece construction, a base wall 20, a tapered side-wall 22, and a lip, flange, or periphery 24. Base 20 and flange 24 are disposed in parallel planes, while diagonally disposed sidewall 22 joins base or bottom wall 20 at corner 26 and flange 24 at corner 28. The offset relationship between base 20 and flange 24 defines the depth "d" to the canopy 12, which exceeds the dimension "D" of cooler 16 projecting beyond building surface 18.

Figure 3:
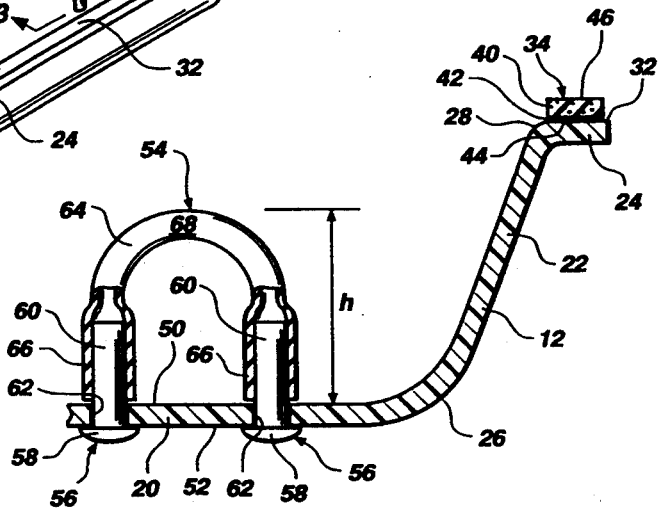
FIG. 3 is an enlarged fragmentary cross-section taken along lines 3—3 of FIG. 2.
Figure 5:
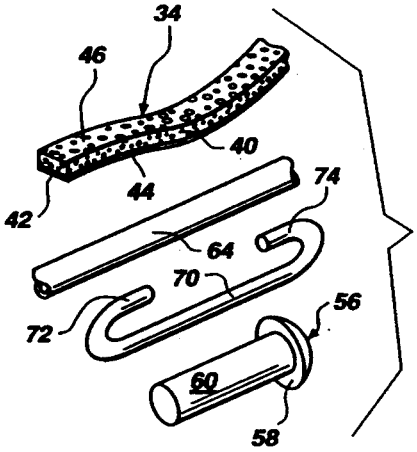
FIG. 5 illustrates in fragmentary perspective components used to assemble and install the cover or canopy illustrated in FIGS. 1 and 2.

As can best be seen in FIG. 3, the diagonal sidewall 22 is formed of four lineal segments, disposed at 90° to each other, which are joined through 90° respectively at corners 30.

Figure 6:
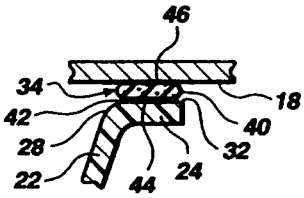
FIG. 6 is an enlarged fragmentary cross-section showing the manner in which the canopy or cover illustrated in FIGS. 1 and 2 is caused to be sealed against a ceiling surface of a house or other building.

While not shown in FIG. 2 (for clarity of illustration, the upper surface 32 (FIG. 3) has weatherstripping, generally designated 34, extending contiguously along the entirety of the four segment flange 24. As is readily apparent from FIG. 2, each segment of the flange 24 is joined to two additional flange segments at right angle corner 36. The weatherstripping 34, which runs around the entire periphery at flange 24, is illustrated as comprising a layer of compressible foam 40, superimposed upon a backing strip 42, which is adhesively secured to the top surface 32 of the flange 24 at interface 44. Thus, when the weatherstripping 34 is caused to be resiliently urged against surface 18, as explained herein in greater detail, a seal is formed between building surface 18 and exposed surface 46 of the weatherstripping 34 by which air flow through the swamp cooler 16 and across the canopy 12 is prohibited. This sealed position is illustrated in FIG. 6. Other sealing material may be used with or in lieu of the weatherstripping, such as pliant caulk.

The bottom or base wall 20, as stated above, is essentially planar in its configuration and comprises a top flat surface 50 and a bottom flat surface 52 defining an essentially uniform thickness across the base 20.

The canopy 10 comprises four identical or substantially identical connectors, each generally designated 54. See, in particular, FIG. 2. Since the connectors 54 are identical or substantially identical, only one will be described. As best illustrated in FIG. 3, each connector 54 comprises spaced studs, each generally designated 56. Each stud 56, preferably formed of solid, shape-retaining synthetic resinous material and formed into a rivet-shaped configuration. Accordingly, each stud 56 comprises a rounded exposed head 58 and a cylindrical rod, stem, or shaft 60.

Rod 60 comprises a uniform diameter and extends through an aperture 62 formed in the base 20 essentially perpendicular to the surfaces 50 and 52. The diameter of the rod 60 and the aperture 62 are substantially the same, or that of rod 60 is slightly greater than that of aperture 62, so that a force-fit relationship exists between the inserted rod or shaft 60 and the aperture 62 to retain the stud 56 in position while preventing air leakage between the rod 60 and the aperture 62.

Accordingly, a substantial length of each rod 60 projects upwardly into the basin or concave area of the canopy 12 above the surface 50, with the studs 56 being positioned in closely juxtaposed pairs, as illustrated in FIG. 3.

A suitable stretchable elastomeric tubing 64 of appropriate length and diameter and possessed of substantial elasticity and memory is placed in a U-shaped configuration between each pair of studs 56. Specifically, each tubing 64, which may be a medical grade tubing of the type used for tourniquets to monitor blood pressure, is cut to a predetermined length and the ends 66 are force-fit over two studs 56 forming a pair of studs comprising one of the connectors 54 so that the diameter of the tubing ends 66 is enlarged substantially, as illustrated in FIG. 3. Thus, the memory forces within the ends 66 compressively grip contiguously against the associated rod 60 to hold the U-shaped tubing 64 in the assembled position even when the central portion 68 thereof is thereafter manually stretched substantially. When the central portion 68 of any U-shaped tubing 64 forming a part of one of the connectors 54 is unstressed, it defines a height "h" above the interior surface 50 of the base 20. See FIG. 3.

Figure 4:
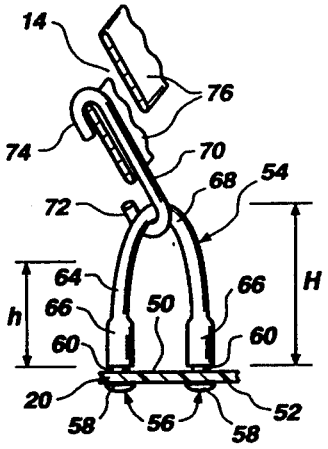
FIG. 4 is an enlarged fragmentary elevation illustrating the manner in which the cover or canopy of FIG. 1 is biased into the closed, sealed relationship with a surface of a house or other building.

To install the canopy 10, the installer may place a metal or plastic C-clip 70 so that one hooked end 72 is placed around the central region 68 of the associated U-shaped tubing 64, as best illustrated in FIG. 4. By manually pulling upon the C-clip 70, the tubing 64 is stretched from the unstressed dimension of "h" to or beyond a stressed dimension "H" and the upper hook 74 placed over one of the air vent louvers 76.

Figure 7:
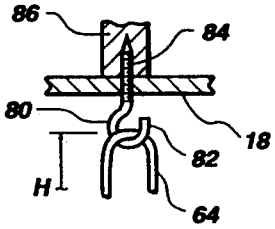
FIG. 7 is a elevation shown partly in cross-section showing the manner in which the canopy or cover of FIGS. 1 and 2 can be biased into its installed, sealed position using building structure in lieu of structure of the swamp cooler.

Alternatively, the C-clip or the central region 68 of the tubing 64 may be directly stretched and placed around a hooked end 82 of an eyelet 80. Eyelet 80 is illustrated as comprising the hooked end 82 (to accommodate receipt of the central tubing portion 68) and a threaded end 84 illustrated in FIG. 7 as being turned into a building structural member 86 of wood, for example.

In any suitable way including the three ways mentioned immediately above, each tubing member 64 of all four connectors 54 is stretched and secured at 68 to a fixed anchor at a building location or a swamp cooler location so that the tensile force in tubing members 64 caused by memory pulls the canopy or closure 12 firmly toward the swamp cooler 16, causing the weatherstrip 34 to be compressed against the building surface 18 to create a seal, as illustrated in FIG. 6. This tensile force applied by the tubing member 64 at central portion 68 of each of the four connector 54 locations is maintained because the dimensional make-up of the cover 10 is such that when installed, none of the tubing members 64 is permitted to retract to an unstressed state at the central portion 68 thereof. Thus, the hood 10 forms a sealed cover over one side of the swamp cooler 16 so as to prevent air flow through the swamp cooler 16 into the interior of the building. The hood 10 may be placed either on the inside or the outside, or both to cover the region occupied by the swamp cooler 16.

The illustrated hood 10 is manufactured by molding a suitable synthetic resinous material so as to form the canopy 12, as illustrated in the Figures. Four sets of two holes 62 each are drilled or otherwise formed in the base 20 of the canopy or closure 12 so that the above-mentioned connectors 54 may be appropriately installed. One stud or post 56 is press-fit into each of the apertures 62 so as to be firmly retained therein and so that each aperture 62 is sealed against air flow. Sections of elastic tubing are cut into appropriate lengths, e.g., six inches. To assist in placement of the ends 66 of the tubing members 64, the ends 66 may be dipped in rubbing alcohol. So lubricated, the ends 66 are facilely stretched over to associated rods 60. Even without rubbing alcohol, however, the tubing may be placed as illustrated in FIG. 3, thereby completing installation of the connectors 54.

The foam weatherstrip 34 is cut into four exact lengths and adhesively secured to the top surface 32 of the four segment flange 24 in such a way that no air space along the weatherstrip 34 exists. At this point, the hood 10 is ready for installation, in the manner described above.

The hood 10 may be removed from its impervious position in regard to the swamp cooler 16, for example, in the spring, by simply repeating, in reverse, the installation steps described above.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A cover for preventing air flow through a swamp cooler at an interior surface within a room of a building comprising:

a rigid canopy comprising a peripheral lip for sealing against said interior room surface around the perimeter of an effluent vent of the swamp cooler;

the rigid canopy comprising a central recessed region sized and shaped to span around the effluent vent of the swamp cooler in spaced relation;

expandable biasing structure connected to the rigid canopy, the expandable biasing structure comprising stretchable elastomeric material with memory;

connector structure for releasible attachment to the expanded biasing structure and to the effluent vent of the swamp cooler to create a continuing bias force by which the lip is urged against the interior room surface.

2. A cover for preventing air flow through a swamp cooler at an interior surface within a room of a building comprising:

a rigid canopy comprising a peripheral lip for sealing against said interior room surface around the perimeter of an effluent vent of the swamp cooler;

the rigid canopy comprising a central recessed region sized and shaped to span around the effluent vent portion of the swamp cooler in spaced relation;

expandable biasing structure connected to the rigid canopy, the expandable biasing structure comprising spaced sets of studs carried at several locations by the recessed region of the canopy and a length of U-shaped stretchable hollow tubing spanning between and superimposed over respective ends of each set of studs;

connector structure for releasible attachment to the expanded biasing structure and to the effluent vent of the swamp cooler to create a continuing, bias force by which the lip is urged against the interior room surface.

3. A cover for preventing air flow through a swamp cooler at an interior surface within a room of a building comprising:

a rigid canopy comprising for sealing against said interior room surface around the perimeter of an effluent vent of the swamp cooler;

the rigid canopy comprising a central recessed region sized and shaped to span around the effluent vent portion of the swamp cooler in spaced relation;

expandable biasing structure connected to the rigid canopy, the rigid canopy comprising shape-retaining synthetic resinous material;

connector structure for releasible attachment to the expanded biasing structure and to the effluent vent of the swamp cooler to create a continuing bias force by which the lip is urged against the interior room surface, the connector structure comprising a rigid C-shaped clip one end of which hooks over a central portion of each stretchable hollow tubing between the two spaced associated studs, the rigid canopy comprising shape-retaining synthetic resinous material.

4. A cover for placement against an interior surface within a room of a building to prevent air flow through a swamp cooler comprising:

a rigid canopy comprising a peripheral lip for sealing against said interior room surface so as to circumscribe the perimeter of an interior discharge vent of the swamp cooler;

the rigid canopy comprising a recessed region sized and shaped to span around the discharge vent of the swamp cooler in spaced relation;

a plurality of elastic biasing elements connected at spaced locations to the rigid canopy;

a connector releasibly attaching each elastic element to a stationary site spaced from the canopy at each spaced location to create spaced continuing bias forces at each spaced location by which the lip is urged against the interior room surface;

each biasing element comprising a length of stretchable elastomeric material with memory.

5. A cover for placement against an interior surface within a room of a building to prevent air flow through a swamp cooler comprising:

a rigid canopy comprising a peripheral lip for sealing against said interior room surface so as to circumscribe the perimeter of an interior discharge vent of the swamp cooler;

the rigid canopy comprising a recessed region sized and shaped span around the discharge vent of the swamp cooler in spaced relation;

a plurality of elastic biasing elements connected at spaced locations to the rigid canopy;

a connector releasibly attaching each elastic element to a stationary site spaced from the canopy at each spaced location to create spaced continuing bias forces at each spaced location by which the lip is urged against the interior room surface;

each biasing element comprising spaced sets of studs connected to the canopy at the interior thereof at closely spaced sites adjacent each of said locations and a length of stretchable hollow tubing comprised of synthetic resinous material spanning in a U-shaped configuration between and superimposed over respective exposed ends of each associated set of studs.

6. A cover according to claim 5 wherein each connector comprises a rigid C-shaped clip one end of which hooks over a central portion of each U-shaped stretchable hollow tubing between the associated two spaced studs.

7. A cover for placement over a charge vent having a predetermined periphery disposed at an interior room surface to prevent air flow through a swamp cooler comprising:

a shape-retaining bulbous-shaped canopy comprising a peripheral sealing lip to surround the periphery of the discharge vent and engage the interior room surface and a central concave region offset from the lip and sized and shaped to span across and around the discharge vent of the swam cooler, connector structure comprising a biasing element with memory spanning between and connected to both the canopy and the discharge vent to thereby bias the sealing lip against the interior room surface to prevent air flow through the discharge vent into the room;

the biasing element comprising a stretchable elastomeric portion comprising memory by which the sealing lip is biased against the room surface.

8. A method of preventing air flow through an interior vent of an installed swamp cooler into an interior room of a building comprising the steps of:

placing an impervious rigid canopy in spaced relation around and across the interior vent of the swamp cooler;

resiliently biasing a peripheral portion of the canopy, by at least one resilient element linearly spanning between the canopy and the vent from a position, away from a surface of the interior room into contiguously releasibly sealed relation against said surface;

the resiliently biasing step being caused by memory forces in stretched elastomeric material.

9. A method according to claim 8 wherein a plurality of the elastomeric elements are stretched between the canopy and the vent of the swamp cooler.

* * * * *